US005787557A

United States Patent [19]

Kurschatke

[11] Patent Number: 5,787,557

[45] Date of Patent: Aug. 4, 1998

[54] TEXTILE TREATMENT UNIT

[75] Inventor: Wolfgang Kurschatke, Krefeld, Germany

[73] Assignee: Eduard Küsters Maschinenfabrik GmbH & Co KG, Krefeld, Germany

[21] Appl. No.: 669,325

[22] PCT Filed: Aug. 13, 1994

[86] PCT No.: PCT/DE94/00931

§ 371 Date: Sep. 23, 1996

§ 102(e) Date: Sep. 23, 1996

[87] PCT Pub. No.: WO95/18254

PCT Pub. Date: Jul. 6, 1995

[30] Foreign Application Priority Data

Dec. 31, 1993 [DE] Germany ..... 43 45 041.5

[51] Int. Cl.[6] ..... D06G 10/04

[52] U.S. Cl. ..... 28/165; 226/119

[58] Field of Search ..... 28/100, 165, 166, 28/167, 168, 169, 171, 219, 170; 226/170, 168, 118, 119; 68/177, 62

[56] References Cited

U.S. PATENT DOCUMENTS

| | | | |
|---|---|---|---|
| 3,442,702 | 5/1969 | Fleissner | 68/177 |
| 3,457,029 | 7/1969 | Drago | 28/177 |

FOREIGN PATENT DOCUMENTS

| | | |
|---|---|---|
| 36293 | 4/1930 | France . |
| 59773 | 7/1954 | France . |
| 2229798 | 12/1974 | France . |
| OS-2104192 | 8/1972 | Germany . |
| PS-1460496 | 4/1976 | Germany . |

*Primary Examiner*—C. D. Crowder
*Assistant Examiner*—Larry D. Worrell, Jr.
*Attorney, Agent, or Firm*—Kenyon & Kenyon

[57] ABSTRACT

A textile treatment unit comprises a belt conveyor which operates continuously, with a conveyor section, on which textile material is transported in folds. The upper side of the belt, with the folds located on it, passes over a local height deviation in the conveyor section, in the form of an elevation formed by a roller arranged below it, causing the folds to be loosened.

10 Claims, 1 Drawing Sheet

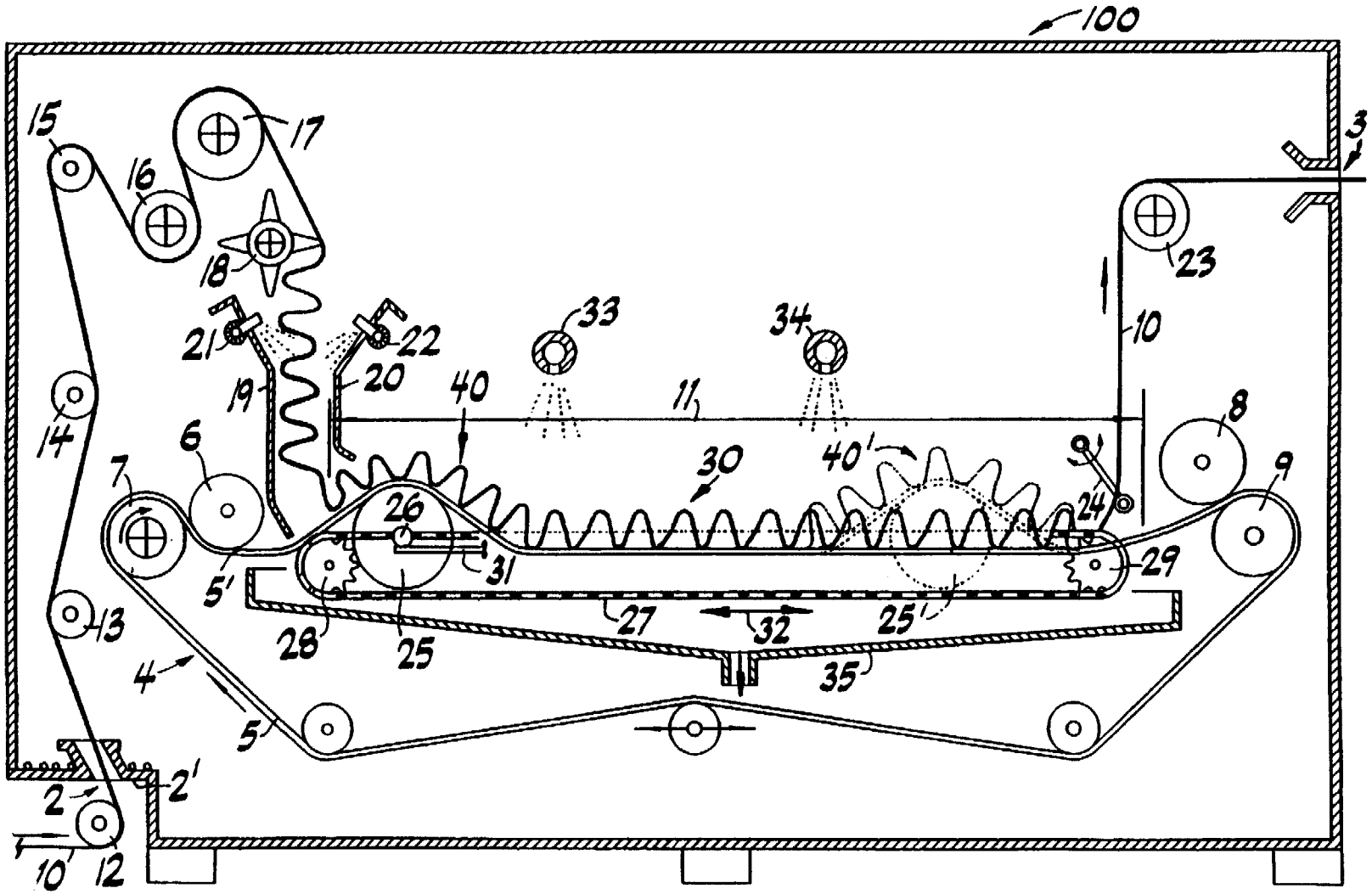
100
3
23
10
8
9
24
29
40'
25'
35
34
32
30
11
27
33
31
40
22
20
26
25
28
17
18
19
21
6
5'
5
4
16
7
13
2'
15
14
12
2
10'

TEXTILE TREATMENT UNIT

BACKGROUND OF THE INVENTION

The invention relates to a textile treatment unit.

Such textile treatment units are known, for example, from German Patent DE-PS 14 60 493. The textile material in web form is placed, in folds, on a belt conveyor by means of a folding device. This belt conveyor is arranged in a housing and has an upper side which runs essentially horizontally, forming the conveyor section. The upper side of the belt forming the conveyor section can be horizontal, but can also have a slight upward or downward incline, the angle of which is limited so that it is not so steep that the folds start to slip.

The belt can be a continuous belt of sheet metal or plastic. In general, however, because of the necessity of atmospheric access to the textile material on all sides, it is a belt made of a screen material. The atmosphere can be an air or steam atmosphere, or a steam/air mixture.

Textile treatment units of this type can hold significant lengths of textile webs and therefore permit relatively long retention and treatment times. They are used, for example, for long-term treatments of dyed and printed fabrics (e.g., soaping processes, hot water processes, etc.), for treatments of knit and woven fabrics for boiling and bleaching processes under steamer conditions, and for shrinkage and relaxation treatments.

In the textile treatment processes of this type, the folded material located within the conveyor section rests on the conveyor and is not affected by any external forces. The folds therefore pass through the conveyor section essentially without being moved. Therefore the amount of shrinkage, for example, depends on the inherent shrinkage forces of the fabric, which forces must be able to overcome the weight of the fabric and cause the fabric to contract. The shrinkage which occurs is therefore limited. In particular, however, there is the risk that when the folds are not moved, in some treatments the folds will become permanently manifested in the fabric due to lack of uniformity of the treatment, and will be evident in the finished product.

SUMMARY OF THE INVENTION

The object of the invention is to improve the treatment effect of a textile treatment unit of the type indicated.

The term "local height deviation" is used herein to mean a limited variation, in terms of length and height, of the essentially level conveyor section. The length should amount to at most one-fifth of the length of the entire conveyor section. The height of the local height deviation should be at most on the same order of magnitude. Cases in which the entire conveyor section has a shallow convex curvature form do not achieve the goal of the invention, which is that the folds resting on the belt are loosened slightly when they pass the local height deviation, so that the textile material gives way to the shrinkage forces, and the folds slip slightly, so that they do not always remain in the same location within the textile material and therefore are not so easily permanently manifested in the finished product.

In one embodiment, the local height deviation is an elevation, i.e., the belt conveyor passes over a hump which extends crosswise to the path of the textile material, resulting in the desired loosening of the folds.

Another possible embodiment comprises a recess, i.e., the belt conveyor, with the folds on it, passes over a valley or channel which extends crosswise to the textile material.

The local height deviation can be produced by guiding the belt of the belt conveyor, e.g., by means of guide elements which act on the edges of the belt. In one preferred embodiment, however, the local height deviation is formed as an elevation by a rotating roller arranged underneath the belt, with the axis of rotation of the roller arranged crosswise to the belt, which roller moves relative to the textile material.

The rotating roller has the advantage that there is no sliding contact roller and the belt and therefore no wear on the underside of the belt. The relative movement between the roller and the textile material has to occur, because if the roller were to remain always at the same location of the belt, the folds resting on the belt would not experience any change, and the desired loosening effect would not occur.

The diameter of the roller should be dimensioned so that the amount of the height deviation, which is a co-determining factor for the loosening effect, is maintained.

The relative movement can be achieved if the roller is mounted in fixed manner and the belt with the folds on it passes over the roller and is locally lifted as a result.

However, the rotation shaft of the roller can also move relative to the textile material, in a plane parallel thereto.

A weakening of the loosening effect may occur if the roller and the belt move in the same direction but at different speeds. However, the loosening effect is intensified if the roller moves in the direction opposite to the belt.

To move the rotation shaft of the roller, it can have its own assigned movement device; this device can comprise a traction element such as a cable or a chain, which runs continuously.

From German Patent Application DE-OS 21 04 192, a broad washing machine or broad finishing machine is known, which comprises a belt conveyor with a horizontal upper side forming the conveyor section. Containers with treatment liquid are provided beneath the upper side. Several groups of three rollers, arranged parallel to one another in a horizontal plane, are provided; they extend into the treatment liquid from above. The upper side of the belt is passed down between the outer rollers and under the center roller in each instance, in V shape. The group of three rollers can be moved back and forth in the associated container, over a certain distance in the belt direction. The textile material resting on the belt is taken down into the V-shaped depression by the center roller in each instance, and is passed through the treatment liquid. This results in continuous saturation of the textile material with the treatment liquid. The function of this device is tied to the existence of groups of three rollers in each instance, and does not serve to loosen folds.

BRIEF DESCRIPTION OF THE DRAWINGS

The drawing schematically shows an exemplary embodiment of the invention.

It shows a vertical longitudinal cross-section through a textile treatment unit.

DETAILED DESCRIPTION

The textile treatment unit designated as a whole by reference numeral 100 in the drawing comprises a box-shaped housing 1 filled with steam, with an inlet 2 and an outlet 3, through which textile material 10 in web form can be continuously transported in the direction of the arrow.

In the housing 1, a belt conveyor designated as a whole by reference numeral 4 is arranged; it essentially takes up the entire length of the housing and has a belt made of a screen material, the upper side 5' of which forms the essentially horizontal conveyor section 11, between pairs of rollers 6, 7 and 8, 9. In the illustrated embodiment, the roller 7 is driven and allows the belt 5 to run continuously in the direction of rotation indicated with the arrow.

The textile material in web form runs over a deflection roller 12 below the inlet 2 formed at a bottom side 2' in the bottom region of the housing 11 into the interior of the housing 1. Within the housing 1, the textile material runs upward over deflection rollers 13, 14, 15, and then passes by tension rollers 16, 17 arranged in the upper part of the housing 1. The textile material then runs over a beater roller 18 arranged below the last tension roller 17, which beater roller is arranged above the beginning of the conveyor section 11, and ensures that the textile material 10 in web form is deposited on the belt 5 in folds, the apices of which extend crosswise to the upper side 5' of the belt 5. On the drop distance between the beater roller 18 and the upper side 5' of the belt 5, the textile material 10 in web form is passed between guide plates 19, 20, at the upper ends of which spray pipes 21, 22 apply hot water or a treatment liquid to the textile material 10 from both sides.

The textile material 10 is conveyed along the conveyor section 11 on the upper side 5' of the belt 5, in folds 30, and at the end of the conveyor section, it is pulled up by a draw-off roller 23, removing the folds, and is pulled out of the outlet 3 by draw-off units, not shown. A measurement sensor 24 makes contact with the end of the folds 30 and ensures that the conveyor section 11 is always filled, i.e., that the folds 30 always extend within the region of the sensor 24, by means of appropriate control of the speed of the prior or subsequent units.

Spray pipes 33, 34 are arranged above the folds 30; a treatment liquid, for example hot water at a temperature of 90°–95° C., can be applied to the textile material 10 from them. The liquid dripping from the textile material 10 is captured by a pan 35 and carried away.

The upper side 5' of the belt 5 normally runs in an essentially horizontal plane. The folds 30 normally would pass along the conveyor section undisturbed, resting calmly on the belt 5.

In order to bring about loosening of the folds 30, a roller 25 which extends crosswise to the web of textile material 10, i.e., to the belt 5, is provided below the upper side 5' of the belt 5, which roller can rotate around a shaft 26, and in turn is guided on endless chains which are passed around rollers 28, 29 near the ends of the conveyor section 11.

The roller 25 is arranged in such a manner that it causes a local height deviation 40 in the form of an elevation of the upper side 5' of the belt 5, with the amount of the elevation being about two-thirds of the diameter of the roller 25. In the illustrated embodiment, the shaft 26 is guided on horizontal rails 31 on both sides of the belt 5, and is alternately moved back and forth across the length of the conveyor section 11 by the chain 27, in the direction of the arrow 32. On the right half of the drawing, a position 25' of the roller 25, reached near the right end of its reciprocating displacement, and the corresponding height deviation 40', are shown with broken lines.

When the upper side 5' with the textile material on it passes the roller 25, the textile material is loosened, which facilitates the shrinkage process and slightly changes the position of the folds.

In addition to the alternating back and forth movement shown in the illustrated embodiment, the roller can also continuously circulate on the chain in a same-directional or in a counter-directional movement. In such a case, it is advantageous to mount several rollers 25 on the chain 27.

A loosening effect is also achieved if the belt 5 runs over one or more rollers mounted in a fixed location.

In the illustrated embodiment, the diameter of the roller 25 is approximately one-tenth of the length of the conveyor section 11. The height of the elevation of the belt 5 produced by the roller 25 should correspond at most to the diameter of the roller. Higher elevations which get into the range of hanging loops are not suitable for the invention, because then the folds 30 would collapse. While the folds 30 are to be loosened, they are to be maintained.

In one exemplary embodiment, the length of the conveyor section 11 amounts to approximately six meters. The production speed lies in the range of thirty to eighty meters per minute. With a maximum of about eighty meters of textile material per meter of the folds 30, this results in a fabric content of about five hundred meters and a textile retention and treatment time of four to ten minutes.

I claim:

1. A textile treatment unit for a web of textile material, comprising:

a belt conveyor with a belt on which the web of textile material can be transported in folds in a conveyor section of the textile treatment unit, with an upper side of the belt in the conveyor section having a horizontal or substantially horizontal path over at least a portion of its length, wherein the web of textile material is supported by and is located on the upper side of the belt in the conveyor section, and at least one local height deviation located in the conveyor section of the textile treatment unit, the local height deviation extending transverse to the upper side of the belt and deviating from the horizontal or substantially horizontal path of the upper side of the belt by a fixed height amount, wherein the upper side of the belt with the web of textile material on it runs over the local height deviation in the conveyor section of the textile treatment unit to loosen the folds of the textile material.

2. A textile treatment unit according to claim 1, wherein the local height deviation is an elevation.

3. A textile treatment unit according to claim 1, wherein the local height deviation is a depression.

4. A textile treatment unit according to claim 1, wherein the local height deviation is formed by a guidance mechanism of the belt.

5. A textile treatment unit for a web of textile material, comprising:

a belt conveyor with a belt on which the web of textile material can be transported in folds in a conveyor section of the textile treatment unit, with an upper side of the belt in the conveyor section having a horizontal or substantially horizontal path over at least a portion of its length, wherein the web of textile material is supported by and is located on the upper side of the belt in the conveyor section, and at least one local height deviation located in the conveyor section of the textile treatment unit, the local height deviation extending transverse to the upper side of the belt, wherein the upper side of the belt with the web of textile material on it runs over the local height deviation in the conveyor section of the textile treatment unit to loosen the folds of the textile material, wherein the local height deviation is an elevation formed by a rotating roller arranged below the upper side of the belt, with a rotation shaft for the roller arranged transverse to upper side of the belt.

6. A textile treatment unit according to claim 5, wherein the diameter of the roller amounts to not more than about one-fifth of the length of the conveyor section.

7. A textile treatment unit according to claim 5, wherein the roller is mounted in a fixed position.

8. A textile treatment unit according to claim 5, wherein the rotation shaft of the roller moves relative to the belt in a plane substantially parallel to the horizontal or substantially horizontal path of the upper side of the belt.

9. A textile treatment unit according to claim 8, wherein the rotation shaft of the roller is moved by a roller movement device.

10. A textile treatment unit according to claim 9, wherein the roller movement device comprises a traction element which runs continuously, substantially parallel to the horizontal or substantially horizontal path of the upper side of the belt, and engages the rotation shaft of the roller.

* * * * *